United States Patent [19]

Mitter

[11] Patent Number: 4,612,874

[45] Date of Patent: Sep. 23, 1986

[54] APPARATUS FOR APPLYING FLOWABLE MEDIA TO WEBS OF TEXTILE MATERIAL OR THE LIKE

[75] Inventor: Mathias Mitter, Schloss Holte, Fed. Rep. of Germany

[73] Assignee: Ramisch Kleinewefers, Krefeld, Fed. Rep. of Germany

[21] Appl. No.: 540,863

[22] Filed: Oct. 11, 1983

Related U.S. Application Data

[63] Continuation-in-part of Ser. No. 498,949, May 27, 1983, abandoned.

[30] Foreign Application Priority Data

Oct. 14, 1982 [DE] Fed. Rep. of Germany ..... 3238084

[51] Int. Cl.[4] ..... B05C 3/02; B41L 13/00; D06B 1/00

[52] U.S. Cl. ..... 118/410; 118/406; 118/419; 101/119; 101/120; 68/200; 8/151

[58] Field of Search ..... 118/213, 211, 410, 413, 118/406, 419; 101/119, 120; 28/169, 178; 68/200, 205 R; 8/151; 427/243, 244, 294

[56] References Cited

U.S. PATENT DOCUMENTS

| | | | |
|---|---|---|---|
| 2,419,695 | 4/1947 | Shuttleworth et al. | 101/119 |
| 3,949,666 | 4/1976 | Zimmer | 101/119 |
| 3,987,724 | 10/1976 | Zimmer | 101/119 |
| 4,158,076 | 1/1979 | Wallstén | 427/294 |

*Primary Examiner*—Norman Morgenstern
*Assistant Examiner*—Ken Jaconetty
*Attorney, Agent, or Firm*—Peter K. Kontler

[57] ABSTRACT

Apparatus for applying a foamed medium to a running workpiece has a tubular housing which is disposed in the interior of a rotary screen and forms part of a slotted squeegee whose outlet allows the foamed medium to flow from the interior of the housing against the internal surface of the screen. The outlet contains one or more deflectors in the form of shoulders, bars, rods or other types of obstacles which prevent the medium from flowing along a straight path from the opening or openings of the housing directly against the internal surface of the screen. This reduces the likelihood of non-uniform application of the medium to the workpiece.

30 Claims, 11 Drawing Figures

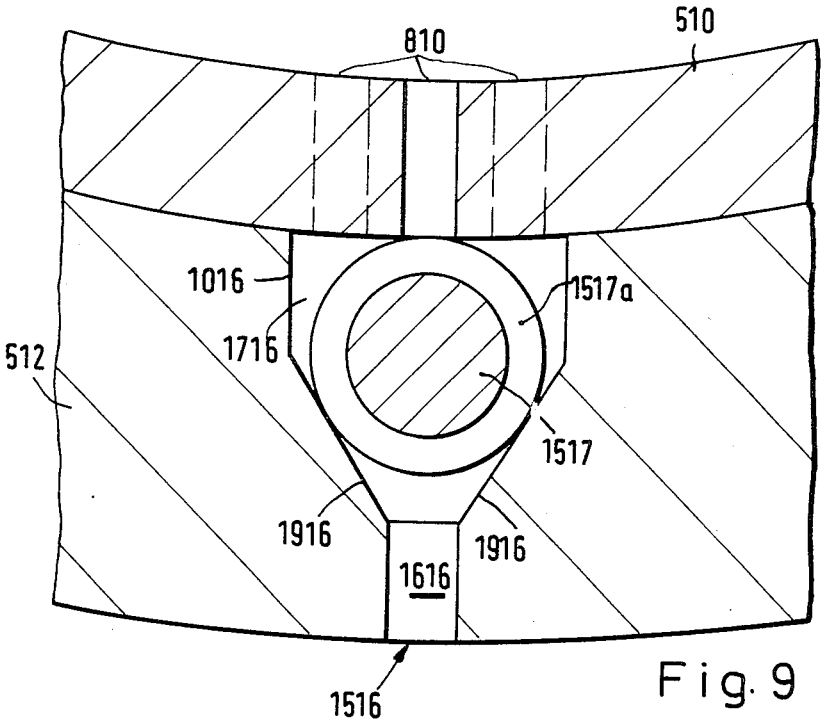
Fig. 9
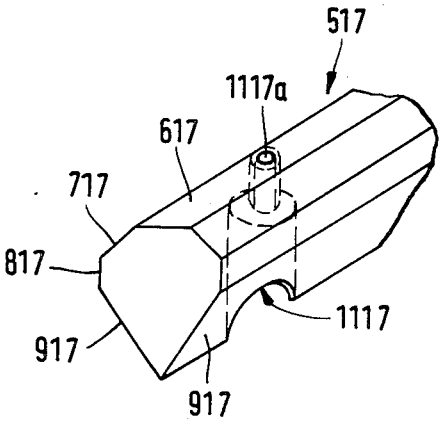
Fig. 7
Fig. 10
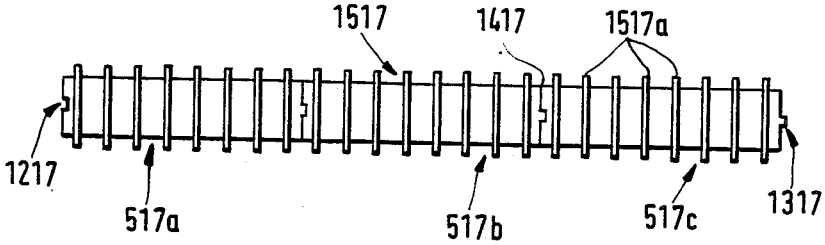

APPARATUS FOR APPLYING FLOWABLE MEDIA TO WEBS OF TEXTILE MATERIAL OR THE LIKE

CROSS-REFERENCE TO RELATED CASE

This is a continuation-in-part of the commonly owned copending patent application Ser. No. 498,949 filed May 27, 1983 now abandoned.

BACKGROUND OF THE INVENTION

The present invention relates to a method and to an apparatus for applying flowable foamed, pasty or liquid media to workpieces, particularly for applying foamed media to running webs of carpeting or the like.

The pile of a running carpet is normally provided with a coat of ink, dye, cleaning agent, impregnating agent, softening agent, stiffening agent and/or another flowable medium by resorting to an apparatus wherein a squeegee or another suitable applicator applies a relatively narrow or a relatively wide layer of flowable medium transversely of one side of the running workpiece, either directly or through the interstices of a screen. Reference may be had, for example, to commonly owned U.S. Pat. No. 4,055,119 granted Oct. 25, 1977.

A drawback of many presently known apparatus of the above outlined character is that the application of a flowable medium to the workpiece is not uniform under any and all circumstances, for example, that the medium is likely to penetrate deeper into the workpiece than contemplated, that the penetration is less pronounced than desired, that regions of excessive penetration alternate with regions of insufficient penetration, and/or that media having different compositions and/or consistencies cannot be applied with the same degree of predictability and reproducibility. One of the reasons for such lack of predictability in the application of flowable media is that certain portions of the stream or streams of a flowable medium which are caused to flow toward and contact the workpiece are free to flow at a higher speed and/or at a higher pressure than the remaining portion or portions of such streams. This results in more pronounced application of flowable medium to certain portions of the workpiece, not for the purpose of causing the applied medium to impart to the workpiece an eye-pleasing design or pattern but rather as a result of unpredictable irregular application of the medium to the workpiece.

Another drawback of many presently known apparatus for the application of foamed or other flowable media to workpieces is that their applicators are bulky and hence difficult to install, especially if the apparatus comprise screens and the applicators must be installed in the interior of such screens together with their supports and with the means for supplying flowable media thereto.

German Offenlegungsschrift No. 25 23 062 discloses an apparatus wherein the applicator of a foamed treating medium includes an elongated box-like housing and a foam generator which is connected with the housing by a conduit. The housing accommodates a set of sheet metal steps or stairs which are intended to effect a cascading of foam in a direction toward the outlet, i.e., toward contact with the workpiece below the housing. The steps or stairs partially overlap each other and extend transversely of the outlet which is constituted by the open underside of the housing. Such arrangement promotes the distribution of foam in the interior of the housing but is incapable of ensuring predictable or uniform distribution of foam in the region where such treating medium comes, or is about to come, into actual contact with the workpiece. The lowermost step or steps are disposed at a considerable distance from and above the workpiece, and the foam must overflow such lowermost step or steps to thereupon drip onto the workpiece. These lowermost steps are parallel to the plane of the workpiece therebelow. The housing must be filled to a level such that all of the steps are confined in the mass of foam. The lowermost step or steps are supposed to prevent the foam from penetrating therebelow. The just discussed apparatus fails to ensure predictable distribution of a foamed treating medium in immediate or close proximity to the plane or path of the workpiece.

U.S. Pat. No. 2,800,075 discloses a slotted squeegee which cooperates with a screen or stencil and is capable of distributing a flowable treating medium across a reasonably wide workpiece. The outlet of the patented squeegee is not a continuous passage because the squeegee is intended for the making of multicolored patterns. However, many presently known slotted squeegees are provided with continuous slots or outlets for evacuation of a treating medium from their interior. Regardless of the continuity or discontinuity of their outlets, the just mentioned squeegees are incapable of ensuring predictable or uniform distribution of a flowable treating medium, especially foam, across the full width of a reasonably wide or very side workpiece, e.g., a carpet whose width approximates, equals or even exceeds five meters. The squeegee of U.S. Pat. No. 2,800,075 includes an elongated housing which is closed save for the outlet which discharges the treating medium in a direction toward the workpiece. The medium which is confined in the housing can be maintained at or above atmospheric pressure. As a rule, the squeegee is installed in a screen printing machine so that the medium which issues from the housing must penetrate through the interstices of a screen or stencil before it can reach the material of the workpiece, e.g., a web or sheet of textile material which is held and/or advanced in a horizontal plane. The treating medium is admitted into the housing of the squeegee by way of one or more conduits, and the entire squeegee is preferably mounted in such a way that it can be moved to any one of several levels with reference to the plane or path of the workpiece.

A problem which invariably arises when one deals with a foamed treating medium is that the "inertia" of foam is very high. Thus, foam tends to remain in the place to which it is delivered and does not exhibit any, or exhibits only a negligible, tendency to spread out and to establish a horizontal upper surface as is the case with readily flowable and even viscous or highly viscous liquids. The tendency of foam to retain its shape (e.g., to pile up at the locus of admission into the interior of a squeegee) is especially pronounced if the percentage of gaseous fraction therein is relatively high. On the other hand, foams exhibit a number of very important advantages which are especially desirable in connection with the application of accurately metered quantities of liquids to stationary or running workpieces, such as webs of carpeting or other types of textile material. Thus, a relatively small quantity of liquid fraction (such as a dye) can be uniformly distributed in a large mass of foam and, if the foam is uniformly spread over a web or sheet of textile material, each unit area of such material can receive a very accurately metered quantity of liquid fraction, namely, a quantity which could not be distributed with the same degree of accuracy if the liquid fraction were supplied to the location of application without a gaseous carrier medium. In other words, there exists an urgent need for an apparatus which would be capable of effecting uniform or predictable distribution of a foamed treating medium over a stationary or running workpiece because such apparatus could be used with great advantage in screen printing and analogous machines for distribution of small quantities of liquids with a heretofore unmatched degree of accuracy and reproducibility. This is important when a workpiece is to be provided with a coat of uniformly distributed liquid treating medium as well as when such treating medium is to be applied only to selected portions of a workpiece. In dealing with foams, one must further bear in mind that a foam must be processed without much delay because even short-lasting stagnation of foam results in decomposition ahead of the workpiece and in unpredictable distribution of the thus segregated liquid fraction in the freshly admitted foam. This is particularly undesirable if the liquid fraction is or contains a coloring agent because the hue or the color of a workpiece can be altered drastically by the presence of excessive quantities of liquid fraction, especially a liquid fraction which was permitted to interrupt its progress toward contact with the workpiece for a longer interval of time.

OBJECTS AND SUMMARY OF THE INVENTION

An object of the invention is to provide an apparatus which is constructed and assembled in such a way that it can apply to carpets or other workpieces a flowable foamed, pasty or liquid medium with a higher degree of uniformity and predictability than heretofore known apparatus.

Another object of the invention is to provide the apparatus with a novel and improved applicator.

A further object of the invention is to provide an apparatus which can exert a beneficial influence upon the flowable medium immediately or closely adjacent to the locus of application of the medium to a workpiece so that such beneficial effect cannot be eliminated or appreciably altered during the remaining stage of propagation of the medium toward and into contact with the workpiece.

An additional object of the invention is to provide an apparatus which can be used as a less expensive, more reliable and more versatile substitute for heretofore known apparatus which are employed to provide webs of carpeting or the like with one or more dyes, impregnating agents and/or other flowable media for the purpose of coloring, impregnating, cleaning and/or other treatment.

Still another object of the invention is to provide the apparatus with an applicator which is more compact and less prone to wear than heretofore known applicators.

A further object of the invention is to provide an applicator which can be installed in certain existing apparatus as a superior substitute for conventional applicators.

Another object of the invention is to provide a novel and improved method of applying flowable foamed, pasty or liquid media to running carpets or other workpieces in such a way that the application is more uniform and/or more predictable than in accordance with heretofore known methods.

An additional object of the invention is to provide an apparatus which can be used with advantage for the application of flowable media to a wide variety of workpieces including webs or sheets of textile material, paper, synthetic plastic material and/or a combination of such workpieces.

Another object of the invention is to provide a method which can be resorted to for the application of a wide variety of flowable media, particularly foamed media, either directly to the workpiece or through the interstices of a stationary or moving screen or stencil.

An additional object of the invention is to provide an apparatus which embodies a novel and improved applicator for a flowable medium and which can be used for the application of flowable media to stationary or running workpieces, to wide or narrow workpieces, to workpieces which exhibit a pronounced pile or have smooth surfaces which are to be coated with or otherwise treated by the medium, and/or to workpieces which are advanced at a low or at an elevated or very high speed.

A further object of the invention is to provide a screen printing machine which embodies the improved apparatus.

Another object of the invention is to provide an apparatus which ensures predictable distribution of a foamed treating medium at a location immediately ahead of the region of actual contact with a workpiece and which, at the same time, prevents direct impingement of streams of a foamed treating medium upon a screen or stencil or directly upon the workpiece.

An additional object of the invention is to provide a novel and improved system of channels and passages for the propagation of a foamed treating medium toward the region of contact with the workpiece.

Still another object of the invention is to provide an apparatus which ensures highly predictable distribution of the liquid fraction of a foamed treating medium on a stationary or running workpiece regardless of whether the workpiece is wide or narrow and irrespective of whether the application should be uniform or confined to certain accurately determined portions of a workpiece.

A further object of the invention is to provide an apparatus which prevents prolonged stagnation of batches of foam on their way toward contact with a screen, a stencil or a workpiece.

Still another object of the invention is to provide a novel and improved method of controlling the progress of foam in a screen printing machine and especially in the applicator (e.g., a slotted squeegee) of such machine.

One feature of the invention resides in the provision of an apparatus for the practice of the above outlined method. The apparatus comprises an applicator including a source of flowable medium having one or more openings, and means defining at least one outlet communicating with the openings of the source and arranged to convey the medium from the source to the workpiece. The applicator further comprises at least one deflector means which is provided in the outlet and serves to prevent the medium from flowing along a straight or substantially straight path from the openings of the source into contact with the workpiece. The apparatus can further comprise a cylindrical or otherwise configurated screen which is interposed between the applicator and the workpiece so that the deflected medium which issues from the outlet must flow through the interstices of the screen on its way into actual contact with the workpiece. The screen preferably surrounds the applicator or at least that portion of the applicator which is immediately adjacent to and supplies the medium to the outlet.

The outlet is preferably elongated and preferably extends transversely of the direction of travel of the workpiece if the workpiece is a running web of textile material, paper or the like, and the outlet defining means of the applicator can comprise a shoe having two elastically deformable sections which flank the outlet. Each of the sections preferably comprises a liner, and each such liner can comprise or constitute a foil made of or exhibiting certain desirable characteristics of Teflon (trademark).

The deflector means can constitute one or more internal shoulders of the applicator. Alternatively, the deflector means can comprise or constitute an elongated member which is installed with clearance in a third or intermediate portion of the outlet between a first portion which receives the medium from the openings of the source and a second portion which discharges the medium from the applicator. The elongated member is positioned in such a way that it prevents the medium from flowing along a straight path between the first and second portions of the outlet, i.e., the medium must flow around the member and is preferably divided into two streams which can merge downstream of the member, e.g., on entry into the second portion of the outlet. The intermediate portion of the outlet can have a substantially circular cross-sectional outline and the deflector means can further comprise disc-shaped or washer-like centering elements provided on the elongated member and contacting the internal surface of the applicator around the intermediate portion of the outlet.

The applicator can constitute a slotted squeegee having a shoe which is mounted directly on the source. The source can comprise an elongated tubular housing which is provided with the openings and supports the shoe, and such source can further comprise means for feeding the flowable medium into the interior of the housing.

The apparatus can further comprise a support for the workpiece, and such support is preferably mounted opposite the applicator and has one or more passages which can register with the outlet of the applicator. Such apparatus further comprises suitable suction generating means whose intake is connected with the passage so that the suction generating means can draw the medium from the outlet of the applicator into the workpiece between the applicator and the support, i.e., in the region between the passage and the outlet.

An additional feature of the invention resides in the provision of an apparatus which comprises an applicator including an elongated housing (such as the aforementioned tubular member of the source of foamed or other suitable flowable medium), and outlet defining means which is supported by the carrier and defines an elongated outlet for the flow of the medium toward the workpiece. The outlet defining means comprises a shoe having two sections which flank the outlet and each of which includes a foil consisting of a material having a low coefficient of friction (e.g., the foils can consist of Teflon). Such foils come in direct contact with the workpiece or with the corresponding side of a screen if the apparatus comprises a screen which is interposed between the applicator and the workpiece. Such apparatus further comprises means for feeding the flowable material into the outlet (the aforementioned housing can form part of such feeding means).

The foils can constitute the respective sections, i.e., the entire applicator can consist of only three components including the housing and two thin or extremely thin foils consisting of a material which does not exhibit a tendency to retain the flowable medium and which has a low or very low coefficient of friction.

Alternatively, the shoe can further comprise elastic cushions each of which is interposed between the housing and a different one of the foils. Such cushions enable the foils to move relative to the housing or vice versa. If the housing is a cylindrical member, the cushions preferably constitute or resemble concave-convex shells whose convex sides are bonded or otherwise connected to the respective foils and whose concave sides are bonded or otherwise connected to the peripheral surface of the cylindrical member.

Still another feature of the invention resides in the provision of an apparatus for applying a flowable foamed, pasty or liquid treating medium to a workpiece, particularly for applying a foamed treating medium to a running web of textile material. The apparatus comprises an applicator (e.g., an elongated slotted squeegee) including a housing and having an elongated outlet serving to convey the treating medium from the housing toward the workpiece, means for supplying the treating medium into the housing, and a deflector which is provided in the applicator in the region of the outlet and serves to distribute the treating medium longitudinally of the outlet before the treating medium contacts the workpiece.

The deflector can comprise a plurality of preferably identical elongated sections which are disposed end-to-end. Each such section can constitute a rod and the apparatus preferably further comprises means for centering the deflector in the outlet of the applicator. Tongue-and-groove connections can be provided between neighboring sections of a composite deflector; alternatively, one of the neighboring end faces of two abutting sections can be formed with a socket (e.g., a blind bore) and the other end face is then provided with a stub which extends into such socket. The deflector may constitute or resemble a rod or it can have a substantially tear-shaped cross-sectional outline. The means for centering the deflector in the outlet can comprise a screw thread or a plurality of relatively thin washers which surround the deflector. The outlet is preferably disposed below the housing and the latter is provided with one or more openings (e.g., one or more longitudinally extending rows of holes) which allow the treating medium to pass from the interior of the housing and into the outlet. The outlet can be defined by a shoe which is attached to the housing. For example, the housing can constitute an elongated horizontal tube or cylinder and the apparatus can further comprise a rotary cylindrical or endless band-like stencil or screen which is interposed between the outlet and the workpiece.

If the deflector consists of two or more aligned sections, the abutting end portions of such sections are preferably disposed between the pairs of neighboring centering elements.

If the deflector is installed in the outlet, the latter preferably includes an enlarged upper portion which is adjacent to the opening or openings of the housing and a narrower lower portion which receives treating medium from the enlarged portion. The deflector is then installed in the enlarged portion and defines therewith at least two channels which deliver the treating medium to the narrower portion of the outlet. The combined width of such channels (as considered transversely of the outlet) preferably equals or approximates the width of the narrower portion of the outlet. The housing can be provided with a pair of surfaces which flank the enlarged portion of the outlet and converge toward each other in a direction toward the narrower portion of the outlet. If the deflector has a tear-shaped cross-sectional outline, it is preferably provided with two lateral facets each of which is adjacent to but spaced from one of the aforementioned surfaces and defines therewith one of the aforediscussed channels. The lateral facets of the deflector preferably define a ridge in the region where the enlarged portion of the outlet merges into the narrower portion. The lateral facets can but need not be exactly parallel to the respective surfaces of the applicator. The aforementioned centering elements preferably abut against the mutually inclined surfaces of the applicator to thereby maintain the deflector at a requisite distance therefrom, i.e., to ensure that the deflector and the applicator define the aforementioned channels for the flow of treating medium toward and into the narrower portion of the outlet.

The novel features which are considered as characteristic of the invention are set forth in particular in the appended claims. The improved apparatus itself, however, both as to its construction and its mode of operation, together with additional features and advantages thereof, will be best understood upon perusal of the following detailed description of certain specific embodiments with reference to the accompanying drawing.

BRIEF DESCRIPTION OF THE DRAWING

FIG. 7 is an enlarged fragmentary perspective view of the deflector means in the apparatus of FIG. 6;

FIG. 9 is a fragmentary transverse vertical sectional view of a further apparatus with deflector means resembling the deflector means of FIG. 2 but installed in a different outlet; and FIG. 10 is a smaller-scale side elevational view of a portion of the deflector means which is shown in FIG. 9.

DESCRIPTION OF THE PREFERRED EMBODIMENTS

Figure 1:
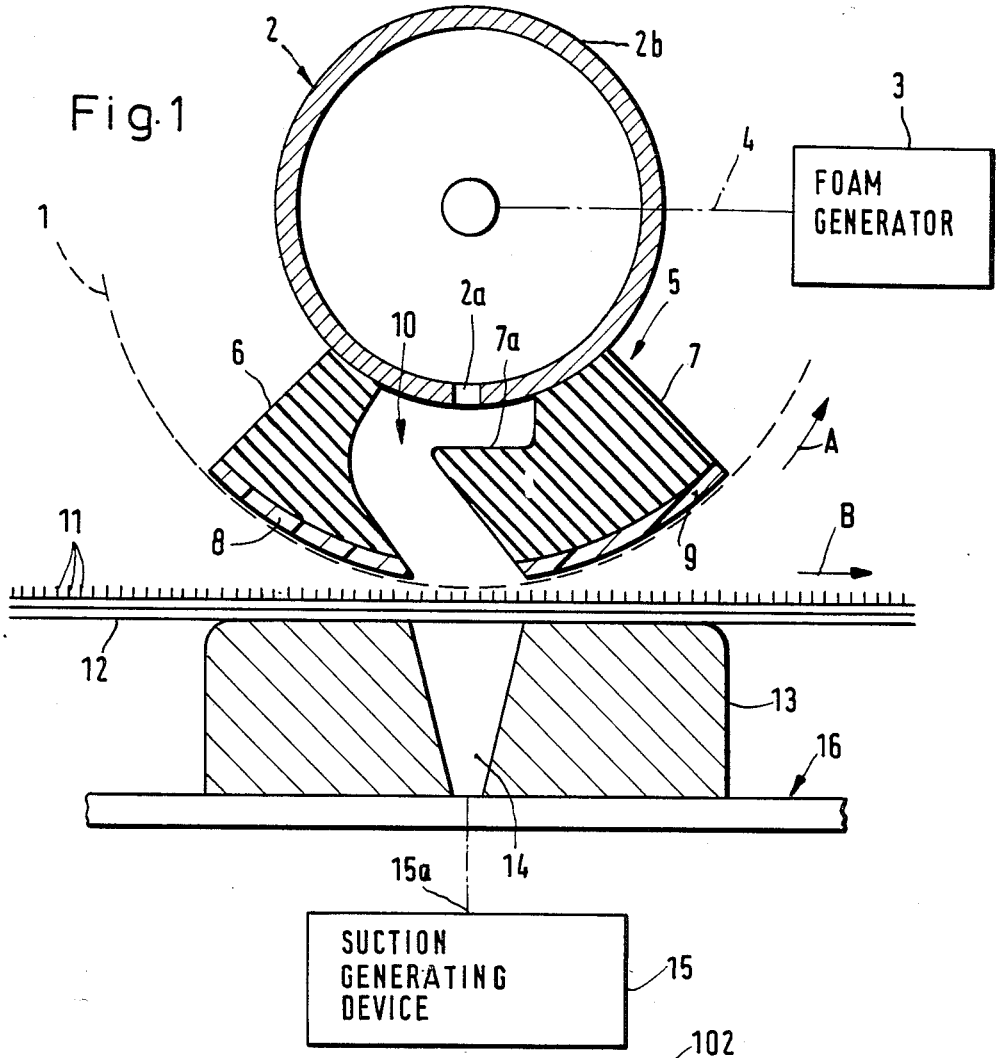
FIG. 1 is a schematic transverse vertical sectional view of an apparatus which embodies one form of the invention and wherein the deflector means constitutes a single internal shoulder in the outlet of a slotted squeegee-like applicator.

Referring first to FIG. 1, there is shown an apparatus which serves to apply a foamed treating medium to the pile of a workpiece 11, e.g., a running web of carpeting which is transported in the direction indicated by an arrow B by a foraminous endless printing blanket 12 or other suitable conveyor means. The apparatus comprises a cylindrical screen 1 whose lowermost portion is in substantially linear contact with the pile of the workpiece 11 and which extends transversely of the direction of transport of the workpiece. The length of the screen 1 can equal or exceed five meters, depending on the width of the workpiece 11. The screen 1 is rotated in the direction of arrow A, either by a discrete drive or in response to advancement of the workpiece 11 with the blanket 12.

The screen 1 confines an elongated tubular member 2 which is a cylindrical pipe extending in parallelism with the axis of the screen and constituting a carrier member or housing of a novel and improved applicator 5. In the embodiment of FIG. 1, the carrier member or housing 2 forms part of a source of flowable foamed medium, and such source further includes a suitable foam generator 3 (e.g., a foam generator of the type disclosed in the commonly owned copending U.S. patent application Ser. No. 300,168 filed Sept. 8, 1981 and incorporated herein by reference) as well as one or more conduits 4 (one indicated by a phantom line) for conveying the foamed medium from the outlet of the foam generator 3 into the interior of the housing 2. FIG. 1 shows schematically that the illustrated conduit 4 discharges the medium into one end portion of the housing 2; however, it is equally possible and often preferred to provide an entire battery of conduits 4 which admit foamed medium into axially spaced portions of the housing 2 so that the interior of this housing is uniformly filled with the medium which is to be applied to the workpiece.

The applicator 5 defines an elongated passage or outlet 10 which extends lengthwise of the screen 1 and housing 2. The uppermost portion of the outlet 10 communicates with the outlet **2*a* of the housing 2; such outlet may constitute a single elongated slot, one or more rows of aligned elongated slots, one or more rows of aligned circular openings or one or more rows of alternating openings and slots. The lowermost portion of the outlet 10 directs the flowable medium against the concave internal surface of the screen 1 so that the medium forms a large number of small streamlets which advance through the interstices of the screen 1 on their way into contact with the pile of the workpiece 11. The applicator 5 further comprises a deflector here shown as an internal shoulder 7*a* provided in the outlet 10 and facing the outlet 2*a* of the housing 2 so that the medium which issues from the housing 2 is prevented from advancing along a straight path directly from the outlet 2*a* and all the way into contact with the pile of the workpiece 11, i.e., into contact with the internal surface of the screen 1**. This reduces the likelihood of irregular or unpredictable application of the medium to the workpiece.

The applicator 5 is a slotted squeegee and further comprises a shoe including two sections in the form of elastic cushions 6, 7 whose concave upper sides are bonded to the peripheral surface 2*b* of the housing 2 and whose convex undersides are bonded to two thin or very thin liners or foils 8, 9. The thickness of the foils 8 and 9 has been greatly exaggerated in FIG. 1 for the sake of clarity. These foils preferably consist of Teflon (trademark) or an equivalent material insofar as its ability to repel the flowable medium (i.e., to prevent the flowable medium from adhering thereto) and its low friction coefficient are concerned. The undersides of the foils 8 and 9 are in direct frictional contact with the internal surface of the screen 1 and these foils flank the lowermost or medium-discharging portion of the outlet 10.

The apparatus of FIG. 1 further comprises a substantially block-shaped support 13 which is disposed at a level below the printing blanket 12, namely, below that portion of the upper reach of the blanket 12 which is adjacent to the outlet 10 of the applicator 5. The support 13 has a passage 14 which is preferably (but need not be) in partial or full register with the lowermost portion of the outlet 10 and which is connected with the intake 15*a* of a pump, fan or another suitable suction generating device 15 serving to draw the flowable medium from the outlet 10, through the interstices of the screen 1 and into the pile of the workpiece 11 on the upper reach of the printing blanket 12. The support 13 and/or the suction generating device 15 is mounted on a frame 16. This frame preferably further supports bearings for the end portions of the screen 1 and bearings for the end portions of the housing 2. Such bearings are not specifically shown in FIG. 1 because their construction and mounting form no part of the present invention. They are disclosed and shown in the aforementioned commonly owned U.S. Pat. No. 4,055,119 which is incorporated herein by reference.

The apparatus of FIG. 1 can be operated without a screen, i.e., the convex undersides of the foils 8, 9 can be placed in direct contact with the upper side of the running workpiece 11. Also, the apparatus can operate without the suction generating device 15, i.e., the support 13 can be omitted or this support can be devoid of a passage (14) and then merely serves as an anvil or prop for the upper reach of the printing blanket 12 at a level directly below the locus of contact between the screen 1 (or foils 8, 9) and the pile of the workpiece 11.

The illustrated deflector 7*a* is an internal shoulder of the right-hand section or cushion 7. Such shoulder can be provided on the section or cushion 6 without departing from the spirit of the invention. Also, the deflector 7*a* can be placed nearer to or further away from the outlet 2*a* of the tubular housing 2.

Figure 2:
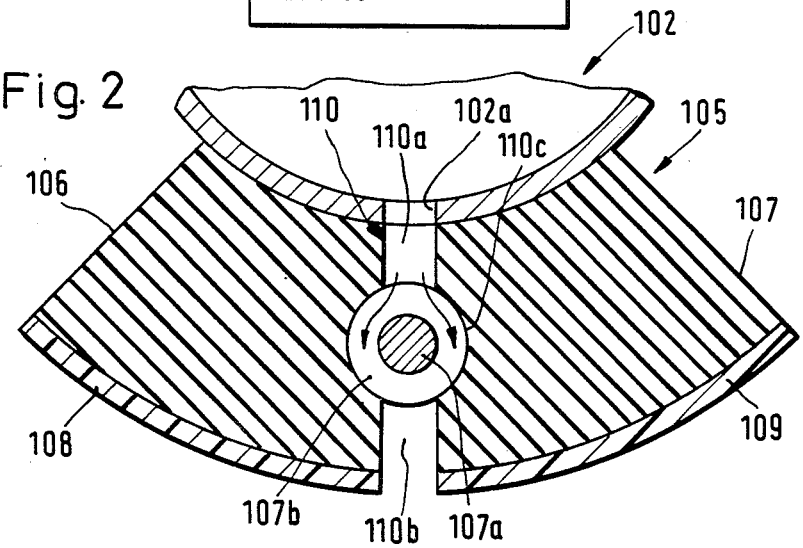
FIG. 2 is a fragmentary transverse vertical sectional view of a modified apparatus whose deflector means includes an elongated rod-like obstacle installed in an enlarged intermediate portion of the outlet in the applicator.

FIG. 2 shows a portion of a modified apparatus wherein all such parts which are identical with or clearly analogous to the corresponding parts of the apparatus of FIG. 1 are denoted by similar reference characters plus 100. The sections or cushions 106, 107 and their foils 108, 109 flank a modified outlet 110 whose first or upper portion 110*a* communicates with the outlet 102*a* of the tubular housing 102 and whose second or lowermost portion 110*b* discharges flowable material into the interstices of a screen or directly onto the upper side of a workpiece, depending upon whether or not the applicator 105 and its housing 102 are installed in the interior of a screen. The outlet 110 further comprises an intermediate or third portion 110*c* which is bounded by a preferably cylindrical internal surface of the applicator 105 and which receives a modified deflector or obstacle including an elongated rod-like member 107*a* provided with several axially spaced disc-shaped centering elements 107*b* (only one shown) which offer little resistance to the flow of flowable medium from the portion 110*a* to the portion 110*c* of the outlet 110 but ensure that the housing 102 provides ample room for the flow of the medium from the outlet 102*a* to the lowermost portion 110*b* and that such flow does not take place along a straight path. The manner in which the deflector including the rod-like member 107*a* breaks up the stream of flowable medium issuing from the portion 110*a* of the outlet 110 into two smaller streams is indicated by the arrows. Such smaller streams merge in the third portion 110*c* or in the lowermost portion 110*b* and form a single stream which then penetrates through the screen or is applied directly to the upper side of the workpiece.

Figure 3:
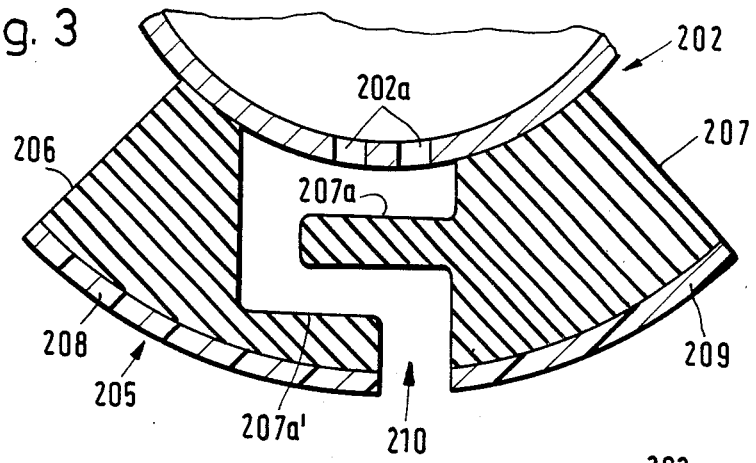
FIG. 3 is a fragmentary transverse vertical sectional view of a third apparatus wherein the applicator presents several obstacles to the flow of a foamed medium along a straight path from the source and all the way to the workpiece.

The apparatus of FIG. 3 constitutes a modification of the apparatus of FIG. 1; all such parts of this third apparatus which are identical with or clearly analogous to the corresponding parts of the apparatus of FIG. 1 are denoted by similar reference characters plus 200. The outlet 210 of the applicator 205 provides a meandering path for the flow of a flowable medium from the outlet 202*a* of the tubular housing 202 of the source of flowable material to the interstices of a screen (not shown in FIG. 3) or directly into contact with a workpiece. The applicator 205 comprises several deflectors in the form of internal shoulders 207*a*, 207*a'* each of which is designed to prevent the flowable medium from advancing along a straight path from the outlet 202*a* and all the way to the screen or to the workpiece. The outlet 202*a* consists of several parallel rows of discrete openings in the form of slots or holes. The cushions 206, 207 of the applicator 205 can consist of foam rubber or an equally soft elastomeric material, and the undersides of such cushions are lined with foils 208, 209 of Teflon or the like.

Figure 3A:
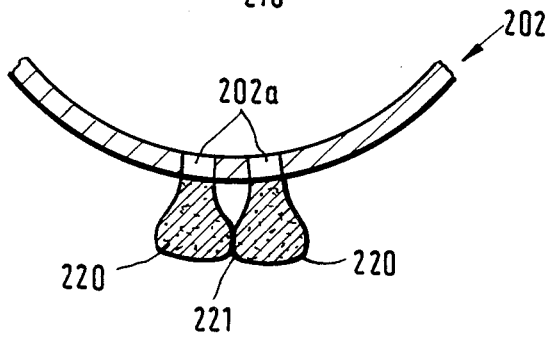
FIG. 3A is a larger-scale view of a detail in FIG. 3.

FIG. 3A shows a portion of the housing 202 and two of the holes which constitute or form part of the outlet 202*a*. The characters 220 denote two streams of foamed medium which issue from the illustrated holes and thereupon expand so that they come in contact with one another. In the region 221 where the two streams 220 come in contact with each other, the streams normally entrap at least some air so that the color and/or consistency of foamed material in the region 221 deviates from the color and/or consistency of the remaining portions of the streams 220. This could result in a non-uniform application of the medium to a workpiece, e.g., in the application of a color having different shades or hues. The deflecting shoulders 207*a*, 207*a'* of FIG. 3 effectively eliminate the likelihood of such non-uniformity of the medium which comes into actual contact with the workpiece by causing the streams 220 to mix ahead of the screen and/or workpiece.

Figure 4:
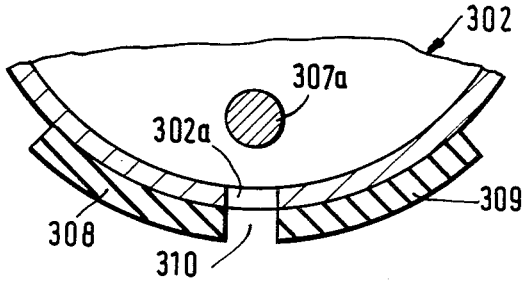
FIG. 4 is a fragmentary transverse vertical sectional view of a fourth apparatus wherein the shoe of the applicator consists of two thin foils.

FIG. 4 shows a portion of a fourth apparatus wherein all such parts which are identical with or clearly analogous to corresponding parts of the apparatus of FIG. 1 are denoted by similar reference characters plus 300. The apparatus of FIG. 4 comprises a greatly simplified applicator which comprises two thin liners or foils 308, 309 bonded to the peripheral surface of the tubular housing 302 at the opposite sides of the outlet 302*a*. This outlet registers with the outlet 310 which is flanked by the foils 308 and 309. If a deflector is provided, it is installed in the interior of the housing 302. FIG. 4 shows, by way of example, a deflector 307*a* in the form of a rod which is disposed at a level immediately or closely above the outlet 302*a* to prevent the flowable medium from advancing along a straight path from the major part of the interior of the housing 302 into direct contact with the workpiece or against the upper side of a screen if the apparatus of FIG. 4 employs a screen. The foils 308, 309 preferably consist of Teflon (trademark) or a material exhibiting similar desirable properties as concerns its low coefficient of friction, resistance to wear, negligible adherence of the flowable medium thereto, convertibility into thin foils and/or resistance to the (often) corrosive influence of the medium which is to be applied to the workpiece.

Figure 5:
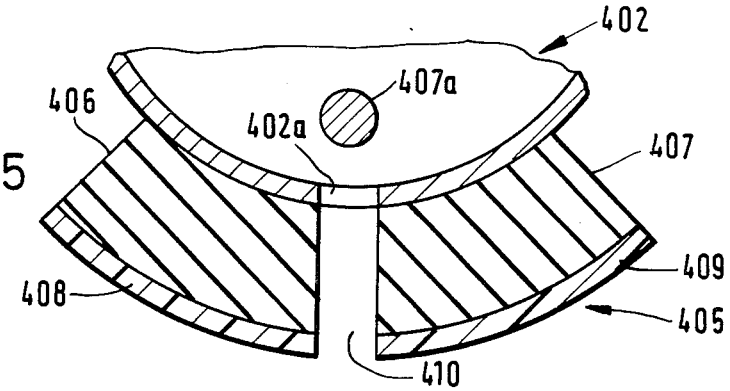
FIG. 5 is a fragmentary transverse vertical sectional view of a fifth apparatus which constitutes a modification of the apparatus shown in FIG. 4.

The apparatus of FIG. 5 is similar to that of FIG. 4 and all such parts thereof which are identical with or clearly analogous to the corresponding parts of the apparatus of FIG. 4 are denoted by similar reference characters plus 100. The only difference between the two apparatus is that, whereas each of the foils 308, 309 shown in FIG. 4 by itself constitutes a shoe of the slotted applicator, the applicator 405 of FIG. 5 comprises two thicker shoes which flank the outlet 410 and each of which comprises an elastic cushion or section (406, 407) whose concave side is bonded to the peripheral surface of the tubular housing 402 and whose convex surface is bonded to the respective foil or liner 408, 409. The sections 406, 407 can consist of foam rubber or an analogous elastomeric material, and their function is to allow for a certain amount of movement of the foils 408, 409 toward or away from the housing 402. The outlet 402*a* is disposed at a level below a rod-shaped deflector 407*a*.

Figure 6:
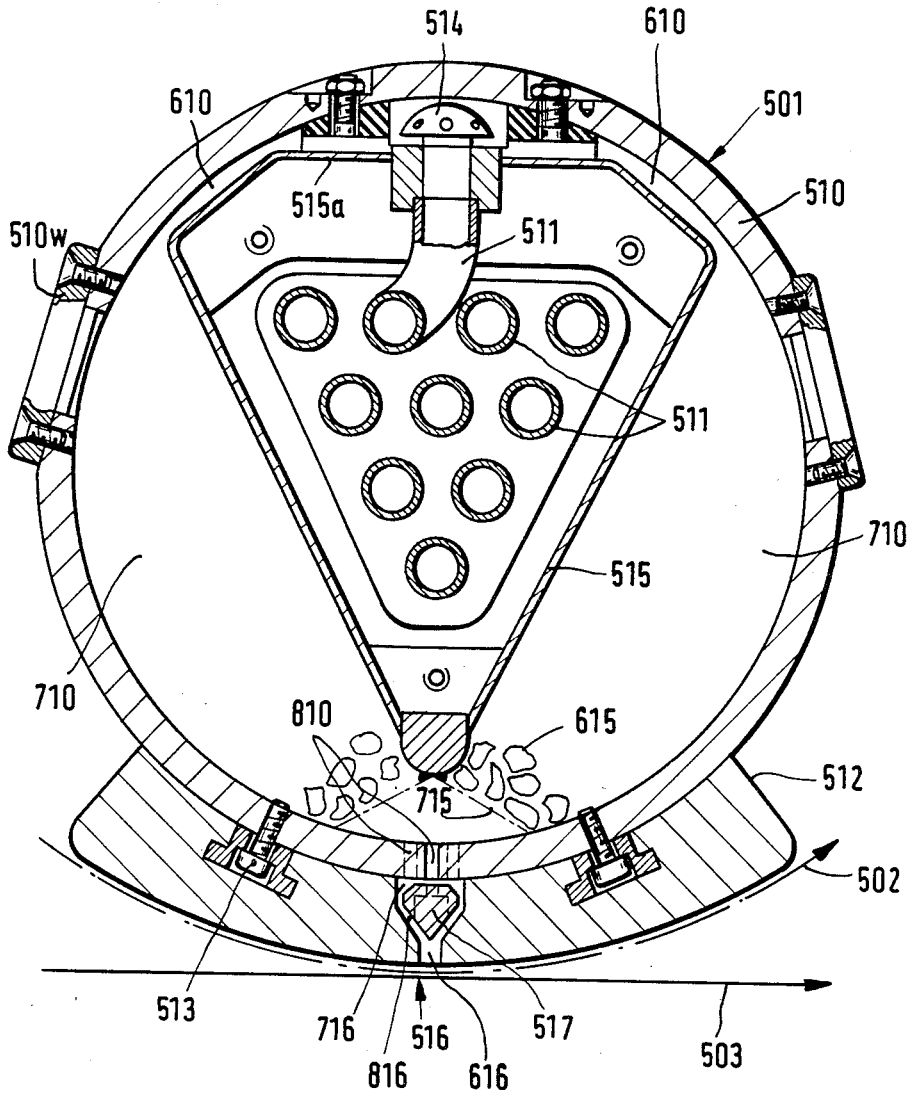
FIG. 6 is a transverse vertical sectional view of a sixth apparatus whose applicator is a slotted squeegee which is installed in the interior of a rotary cylindrical screen or stencil.
Figure 8:
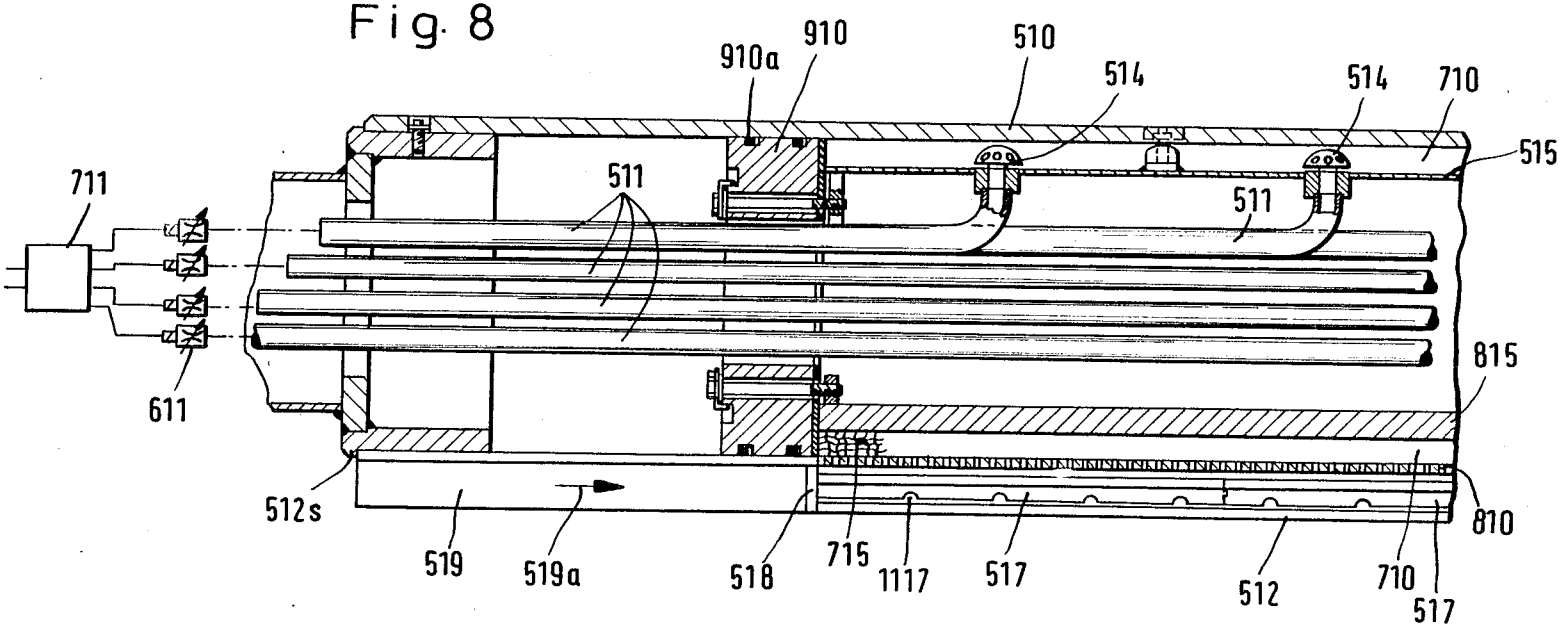
FIG. 8 is a smaller-scale fragmentary longitudinal vertical sectional view of the apparatus which is shown in FIG. 6.

Referring to FIGS. 6, 7 and 8, there is shown a sixth apparatus 501 which is somewhat similar to the apparatus of FIG. 2 and wherein the deflector or obstacle 517 not only prevents unimpeded flow of a treating medium from the chamber 710 of the housing 510 directly into contact with a workpiece 503 or the internal surface of a rotary cylindrical screen 502, but such deflector also ensures more uniform distribution of the treating medium as considered in the longitudinal direction of the outlet 616. The latter extends transversely of the workpiece 503 which is assumed to be transported in a direction to the right, as viewed in FIG. 6, e.g., by an endless printing blanket which is not specifically shown. The apparatus 501 constitutes a slotted squeegee whose tubular housing 510 is an elongated hollow cylindrical member consisting of a metallic material and supporting an arcuate shoe 512 consisting of two sections resembling the sections 6 and 7 of FIG. 1. The shoe 512 is secured to the housing 510 by screws, bolts or other suitable fasteners 513. The convex underside of the shoe 512 conforms to the internal surface of the screen 502 which is or can be provided with alternating interstices and non-permeable portions, depending upon whether the workpiece 503 is to be provided with a uniform coat of a foamed treating medium or whether such medium is to be applied only to selected portions of the workpiece. Suitable rotary cylindrical screens and stencils are disclosed, for example, in German Pat. No. 20 26 492. It is also possible to replace the illustrated rotary cylindrical screen or stencil 502 with an endless band-like screen or stencil which is trained over several rollers and has a flat lower reach in contact with the workpiece. Such band-like stencils and screens are disclosed, for example, in German Pat. No. 22 58 892.

The means for supplying a foamed treating medium into the interior of the housing 510 comprises a plurality of conduits 511 which are disposed in the interior of a tubular displacing member 515. The intake ends of the conduits 511 can receive a foamed treating medium from a suitable foam generator. A static foam generator is disclosed, for example, in the aforementioned German Offenlegungsschrift No. 25 23 062, and a dynamic foam generator is disclosed, for example, in U.S. Pat. No. 4,193,762.

The discharge ends of the conduits 511 constitute or comprise distributor heads 514 which extend upwardly through the top wall 515*a* of the displacing member 515 and discharge streamlets of foam into a channel 610 which forms part of the internal chamber 710 of the housing 510. The distributor heads 514 are staggered, as considered in the axial direction of the housing 510, so as to ensure highly uniform distribution of foam in the chamber 710. The uniformity of distribution is promoted by the displacing member 515 which takes up a substantial part of the chamber 710. In addition, the remaining portion of the chamber 710 is or can be filled (either entirely or in part) by relatively small particulate displacing elements 615 in the form of spheres made of a metallic, synthetic plastic, vitreous or ceramic material, particles of gravel or rock and/or others. Such displacing elements establish a maze of minute paths for the advancement of foamed treating medium from the distributor heads 514 toward the outlet 516 which is defined by the shoe 512 and which receives foamed medium by way of one or more rows of holes, short slots, holes and slots and/or other types of openings 810 together constituting the outlet of the housing 510. These openings communicate with the lowermost portion of the chamber 710 as well as with the outlet 516 between the two mirror symmetrical halves or sections of the shoe 512. A roof-shaped sieve 715 is mounted in the chamber 710 above the openings 810 to prevent the displacing elements 615 from clogging the openings of the housing 510 or from unduly obstructing the flow of foamed treating medium from the chamber 710 into the outlet 516. If the openings 816 are holes or bores, and if such holes or bores form several rows extending in parallelism with the axis of the housing 510, the holes or bores in the neighboring rows are preferably staggered with reference to each other, as considered in the axial direction of the housing 510.

The outlet 516 includes a relatively narrow slot-shaped lowermost or outermost portion 616 which is immediately adjacent to the internal surface of the lowermost portion of the screen 502, and an enlarged upper or inner portion 716 whose width increases in a direction upwardly and away from the lowermost portion 616 and which has an uppermost part of constant width in communication with the openings 810. In accordance with a feature of the invention, the inner or upper portion 716 of the outlet 516 receives the elongated deflector or obstacle 517 which performs the function of the shoulder 7*a*, 207*a* or 207*a*' or the member 107*a*, i.e., it prevents the foam from advancing along a straight path from the openings 810 directly into contact with the screen 502 or (in the absence of a screen) directly into contact with the workpiece 503. In addition, the deflector 517 contributes to more uniform distribution of foam in the outlet 516, as considered in the axial direction of the housing 510. The cross-sectional outline of the deflector 517 resembles the outline of a droplet, and its external surface defines with the adjacent internal surfaces of the shoe 512 two relatively narrow channels 816 wherein the foam can flow from the openings 810 into the lowermost portion 616 of the outlet 516. The distributing action and/or the deflecting action of the deflector 517 is not unduly affected if this deflector is placed above the openings 810, i.e., into the space between the two halves of the roof-shaped sieve 715.

As can be readily seen in FIG. 7, the deflector 517 has a flat horizontal top face or top facet 617 and downwardly sloping convergent lateral faces or facets 917. Additional longitudinally extending faces or facets 717 and 817 are disposed at both sides of the deflector 517 between the top facet 617 and the respective lateral facets 917. The facets 817 are substantially vertical, and the facets 717 diverge and slope downwardly from the respective edges of the top facet 617. The lateral facets 917 make an acute angle. The deflector 517 of FIG. 7 constitutes but one form of means for deflecting and simultaneously distributing the mass of foam which is about to enter the lowermost portion 616 of the outlet 516 in the shoe 512. This deflector is an elongated bar-shaped body which extends along the full length of the outlet 516 and may be made of a metallic, synthetic plastic or other suitable material. The underside of the deflector 517 is provided with longitudinally spaced-apart sockets 1117 for the heads of screws or bolts whose shanks extend through vertical holes 1117*a* and into the material of the housing 510 to separably secure the deflector to the applicator 501. The screws maintain the top facet 617 at a requisite distance from the adjacent portion of the external surface of the housing 510 so as to allow the foam to flow from the openings 810 into the upper portion 716 of the outlet 516 in the shoe 512. Alternatively, one or more distancing elements can be inserted between the top facet 617 and the adjacent portion of external surface of the housing 510 in order to ensure an optimum flow of foam from the openings 810 into the outlet 516.

The streamlets of foam which are forced to pass through the openings 810 of the housing 510 are intercepted by the top facet 617 of the deflector 517 and are caused to flow sideways along the facets 717, 817, 917 toward and into the lowermost portion 616 of the outlet 516. The combined width of the channels 816 (wherein the foam flows during propagation along the facets 917) can equal the width of the lowermost portion 616 of the outlet 516. The junction zone at the locus of meeting of the lateral facets 917 receives two wide streams of foamed treating medium, and such wide streams merge to form a single stream which fills the lowermost portion 616 of the outlet 516 to ensure predictable feed of foam toward successive increments of the rotating screen 512 in the region directly below the deflector 517. Such mode of confining the foamed treating medium to flow around the deflector 517 contributes significantly to uniform filling of the outlet portion 616 with foam and hence to predictable application of the liquid fraction of foam to the workpiece 503. The bubbles of foam are largely destroyed on contact with the screen or stencil 502. A screen will be used if the entire upper side of the workpiece 503 is to be provided with a uniform layer of liquid fraction (e.g., an ink or dye) of the foam, and a stencil is employed if the liquid fraction is to form on the workpiece a pattern of patches of a coloring agent or the like. At the present time, the improved apparatus is used primarily for the application of dyes or the like to webs or sheets of textile material, particularly to the piles of carpets. However, the liquid fraction of the foam can also constitute or contain an impregnating agent, a stiffening or softening agent, a rinsing or washing agent, or an agent which reacts with the ingredient or ingredients of one or more previously applied treating media. Water is one of the liquid fractions which can be applied to the workpiece in lieu of or as a carrier for a dye. In addition to carpets, the apparatus of FIGS. 6, 7 and 8 can also treat a variety of other (woven or non-woven) textile materials including velvets, plushes, felts and/or others. Furthermore, the workpiece 503 can constitute a web, sheet, film or foil which is made of a metallic, synthetic plastic or other material (e.g., a web or sheet of paper). Moreover, the apparatus can be used for the application of liquid fractions of foams to rigid plate-like objects, such as floor tiles (especially tiles which contain or consist primarily of fibrous material), plates of wood or the like.

FIG. 8 is a fragmentary longitudinal vertical sectional view of the apparatus which is shown in FIG. 6. The distributor heads 514 of the conduits 511 in the tubular displacing member 515 are staggered relative to each other, as considered in the axial direction of the housing 510, to thus ensure uniform distribution of foam in the two channels 610 leading to the major parts of the internal chamber 710 of the housing 510. It is preferred to install the distributor heads 514 at identical distances from one another. The reinforcing bar 815 at the lowermost point of the displacing member 515 extends lengthwise of the housing 510 and supports the roof-shaped sieve 715.

A sealing element 518 in the outlet 516 is adjacent to the left-hand end of the deflector 517, as viewed in FIG. 8, in order to prevent escape of foam beyond the respective end of the chamber 710 in the housing 510. This sealing element can also serve as a means for maintaining the deflector 517 in assembled condition if the deflector is assembled of two or more aligned sections. The sockets 1117 for the heads of screws or bolts which separably secure the deflector 517 to the housing 510 are uniformly spaced from each other, as considered in the longitudinal direction of the outlet 516. The sealing element 518 can constitute an insert which is made of rubber or another elastomeric material and is biased against the respective end face of the deflector 517 by an elongated pusher 519 which is installed in the outlet 516. The length of the pusher 519 (which abuts against a shoulder 512*s* of the shoe 512) suffices to ensure that the insert 518 is at least slightly compressed in order to maintain the deflector 517 in an optimum position as well as to prevent foam from escaping laterally beyond the respective marginal portion of the workpiece. If the shoulder 512*s* is omitted, the pusher 519 can be inserted in the direction of arrow 519*a* and is thereupon separably secured to the shoe 512 to prevent any shifting of or relaxation of pressure upon the insert 518. A similar insert 518 and a second pusher can be installed in the other end portion of the outlet 516. The provision of such inserts and pushers is especially desirable and advantageous if the deflector 517 is assembled of two or more aligned sections which should be biased toward each other to thus ensure that the deflector remains in assembled condition.

The left-hand end of the chamber 710 in the housing 510 of FIG. 8 is sealed by an end wall 910 having O-rings 910*a* or analogous sealing elements in sealing engagement with the internal surface of the housing 510. The end wall 910 has a central opening for the conduits 511, and each such conduit is preferably provided with an adjustable regulating valve 611 which allows for accurate metering of the quantity of foam that reaches the respective distributor head 514 per unit of time. The reference character 711 denotes a foam generator having several outlets, one for each of the conduits 511. The illustrated single foam generator can be replaced with two or more discrete sources of foam. For example, if the means for supplying foam into the chamber 710 of the housing 510 comprises two sets of conduits, and if such sets of conduits enter the applicator through the respective ends of the housing 510, the apparatus can comprise a discrete foam generator for each set of conduits 511.

FIG. 9 shows a portion of a modified apparatus. The applicator of this apparatus is a slotted squeegee having a cylindrical housing 510 with several rows of openings 810 and a shoe 512 with an outlet 1516 which is similar to the outlet 516 of the shoe shown in FIG. 6. This outlet includes a lowermost or outermost portion 1616 of constant width and an inner or upper portion 1716 which communicates with the lowermost portion 1616 as well as with the openings 810 of the housing 510. FIG. 9 shows that the housing 510 has an outlet consisting of three parallel rows of openings in the form of holes 810. The holes 810 of the central row are staggered with reference to the holes of the two outer rows. The inner portion 1716 of the outlet 1516 is flanked by two mutually inclined downwardly sloping convergent surfaces 1916 of the shoe 512 and by two vertical surfaces 1016 which terminate at the external surface of the housing 510.

The deflector 1517 of FIG. 9 is similar to the deflector 107*a* of FIG. 2. It also comprises or constitutes an elongated rod-like member whose axis is parallel to the axis of the housing 510 and which is installed in the upper portion 1716 of the outlet 1516 in the shoe 512. The deflector 1517 is surrounded by a set of preferably thin disc-shaped centering elements 1517*a* whose outer peripheral surfaces abut against the surfaces 1916 and thus maintain the deflector 1517 in an optimum position with reference to the openings 810 of the housing 510 and lowermost portion 1616 of the outlet 1516. The illustrated centering elements 1517*a* can be replaced by one or more screw threads providing helical paths for the flow of foam from the openings 810 into the lowermost portion 1616. Disc-shaped (actually washer-like) centering elements of the type shown in FIG. 9 are preferred at this time because they can be simply slipped onto a relatively inexpensive rod-shaped deflector, because they can be readily distributed at desired distances from one another, as considered in the axial direction of the deflector 1517, and also because their cost is very low. Another advantage of disc-shaped or washer-like centering elements is that it is simpler to assemble the deflector 1517 of several coaxial components or sections.

As shown in FIG. 10, the deflector 1517 can be assembled of a series of identical coaxial rod-shaped sections including those denoted by the reference characters 517*a*, 517*b*, 517*c*. One end face of each such section is formed with a diametrically extending groove or socket 1217 and the other end face of each section is formed with a diametrically extending tongue or projection 1317 which can be fitted into the socket of the adjacent section. In this manner, a desired number of sections 517*a*, 517*b*, 517*c* . . . can be assembled into a deflector of requisite length. The illustrated sockets and tongues 1217, 1317 can be replaced with blind bores and pins or stub shafts without departing from the spirit of the invention. Other connections between neighboring sections of a composite rod-shaped deflector can be employed with similar or equal advantage.

The length of each section of the deflector 1517 may be in the range of a few centimeters or a multiple thereof. This depends on the overall length of the deflector and on the desired minimum effective length of the applicator using such deflector.

The centering elements 1517*a* provide a large number of channels which allow the foam to flow from the openings 810 of the housing 510 toward the lowermost portion 1616 of the outlet 1516 in the shoe 512. Means can be provided to hold the sections 517*a*, 517*b*, 517*c* . . . in assembled condition; for example, such means can include springs reacting against the shoe 512 and bearing upon the exposed end faces of the two outermost sections of a fully assembled deflector. The centering elements 1517*a* can be held in requisite positions by friction, by an adhesive, by diametrically extending pins of the deflector 1517 or in any other suitable way. The provision of numerous channels between neighboring centering elements 1517*a* contributes significantly to the uniformity of distribution of foam in the outermost or lowermost portion 1616 of the outlet 1516 and hence to superior quality of the finished workpiece.

A further advantage of a composite (multi-section) deflector is that the relatively short sections can be machined or otherwise formed and finished with a much higher degree of precision than a relatively long one-piece deflector or a small number of relatively long sections which are to be assembled into a deflector that much span a wide or a very wide workpiece. Moreover, a relatively long composite deflector can be rapidly converted into a shorter deflector or into an even longer deflector by the simple expedient of removing or adding a required number of sections. Still further, a damaged composite deflector can be repaired by the simple and inexpensive expedient of replacing one or more damaged sections with fresh sections which are assembled with the remaining sections. The surfaces bounding the outlet in the shoe 512 can be finished with such degree of precision that a deflector which is surrounded by a set of suitable centering elements can be simply inserted into the passage and need not be fixedly secured to the housing and/or to the shoe.

The apparatus which is shown in FIGS. 6 to 8 (with the illustrated deflector 517 or with the deflector 1517 of FIGS. 9 and 10) can be modified in a number of additional ways. Thus, the housing 510 need not constitute a cylindrical tube for the displacing member 515 and additional displacing elements 615. Housings having a polygonal or oval cross-sectional outline can be used with equal advantage. Moreover, the cross-sectional outline of the deflector can depart from that of the deflector 517 or 1517. The disc-shaped centering elements 1517*a* can be replaced with star-shaped centering elements or by sets of pins extending radially from a rod-shaped deflector to center the latter in the outlet of the shoe. Still further, and as already mentioned above, the tongue-and-groove connections 1317, 1217 between neighboring sections of a composite deflector can be replaced by blind bores and stubs or by any other type of cooperating male and female connectors which are capable of holding the neighboring sections of a composite deflector in requisite positions relative to one another. For example, the sections of a composite deflector can be provided with bayonet locks or with other types of claw-like connectors which can ensure that the neighboring sections cannot move away from one another except upon appropriate angular displacement of neighboring sections with reference to each other. It is desirable to provide connections which ensure that the cross-sectional areas of the joints 1417 between neighboring sections is the same as the cross-sectional area of the remainder of the assembled deflector. FIG. 10 shows that the joints 1417 between the neighboring sections of a composite rod-like deflector are preferably disposed between two centering elements 1517*a* rather than immediately at such centering elements.

The effective length of the applicator in the improved apparatus can approximate or even exceed five meters. This is the maximum width of carpets and other workpieces which are presently treated in screen printing and analogous machines.

The width of the channels 610 which lead from the distributor heads 514 into the main portions of the chamber 710 can increase or decrease in the direction of flow of foamed treating medium from the ports of the distributor heads 514 toward the openings 810 of the housing 510, depending upon whether the treating medium is to be accelerated or decelerated. The main displacing member 515 can have an other than triangular cross-sectional outline, and the main portions of the chamber 710 can contain displacing elements 615 which consist of one and the same material or of two or more different materials. Also, the chamber 710 can be partially or completely filled with differently shaped or identically shaped and dimensioned displacing elements. Such displacing elements are insertable into or removable from the chamber 710 by way of normally sealed windows 510w in the housing 510.

The deflector can have a polygonal cross-sectional outline. Deflectors having a tear-shaped or circular cross-sectional outline are preferred at this time because they are least likely to cause a bursting of gas bubbles in the foam which flows around the deflector and toward the screen or stencil or directly into contact with a workpiece. By properly distributing the centering elements 1517*a*, as considered in the longitudinal direction of the deflector 1517, one can regulate the rate of flow of foam to selected portions of the outlet 1516. This is important and advantageous when the consumption of foam in certain portions of the outlet is more pronounced than in the others, for example, because the part 502 is a stencil with interstices and non-permeable portions so that the rate of consumption of foam in the regions of non-permeable portions is much less pronounced or even zero. In other words, the deflector and its centering elements can ensure uniform distribution of foam along the full length of the outlet if such uniform distribution is desired and advantageous, or they can ensure predictable non-uniform distribution to account for non-uniform consumption of foam along the outlet, i.e., as considered transversely of a running web of textile material or the like. The numerous relatively narrow channels between neighboring centering elements on a rod-like or similar deflector have been found to be capable of exerting a pronounced influence upon the distribution of foam in the lowermost or outermost portion of the outlet. It is important to convey the foam from the interior of the housing to the outermost portion of the outlet in such a way that the bubbles of foam will burst only or primarily on contact with the stencil or screen rather than in the shoe.

It is also contemplated to place two or more applicators end-to-end and to regulate the flow of foamed treating medium in each applicator independently of the other applicator or applicators. Such apparatus may be desirable and necessary if the rate of consumption of foam (as considered transversely of a relatively wide workpiece) is likely to fluctuate within a very wide range. However, in most instances, a single applicator will extend across the full width of a relatively wide or a relatively narrow workpiece. Applicators of adjustable effective length can be used with equal advantage. Reference may be had to the commonly owned copending patent application Ser. No. 541,106 filed Oct. 12, 1983. Still further, the width (cross-sectional area) of the outlet need not be uniform all the way from the one to the other axial end of the shoe, i.e., it is possible to provide a composite outlet and to install therein a composite deflector with sections offering different resistance to the flow of foam from the openings of the carrier member toward the lowermost or outermost portions of the respective sections of the outlet. The deflector can be installed in the lowermost portion of the outlet in the shoe, for example, if the shoe is relatively thin (refer, for example, to FIG. 4) so that a relatively stable deflector must be dimensioned in such a way that it extends substantially all the way between the openings of the carrier member and the lowermost portion of the outlet in the shoe.

Each and every embodiment of the present invention exhibits the important advantage that the flow or propagation of foam can be controlled all the way toward actual contact with the screen, stencil or workpiece and also that such flow or propagation can be controlled with a heretofore unmatched degree of accuracy immediately ahead of the locus of contact with the screen, stencil or workpiece. The channels which are formed by the centering elements 107*b* or 1517*a* effect an acceleration of the respective streamlets of foam toward the locus of contact with the screen, stencil or workpiece. Such channeling of the foam immediately before it leaves the applicator results in uniform filling of the lowermost portion of the outlet in the shoe, especially if the pressure of foam in the housing of the applicator is above atmospheric pressure. In such apparatus, the deflector performs several important and desirable functions, namely, it prevents streamlets of foam from flowing along a straight path directly from the supply in the housing toward contact with the screen, stencil or workpiece; it changes (or it can change) the speed of foam on its way toward the lowermost portion of the outlet in the shoe; it effects uniform or predictable distribution of foam in the lowermost portion of the outlet; and it brings about such advantages without causing a pronounced decomposition of foam, i.e., without causing the bubbles of entrapped gas to burst ahead of the screen, stencil or workpiece.

A further important advantage of the improved method and apparatus is that the deflector automatically steers larger quantities of foam into those regions of the outlet in the shoe where the consumption is greater, i.e., where the rate of application of foam directly to a workpiece or to the adjacent side of a screen or stencil is higher than elsewhere along the outlet. As mentioned above, this will take place in screen printing and analogous machines wherein the foam is conveyed toward contact with a stencil having interstices and non-permeable portions in order to ensure that the liquid fraction of foam will be deposited on the workpiece in the form of a predetermined pattern.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of my contribution to the art and, therefore, such adaptations should and are intended to be comprehended within the meaning and range of equivalence of the appended claims.

I claim:

1. Apparatus for applying a flowable foamed treating medium to a workpiece, particularly for applying a foamed medium to a running web of carpeting or the like, comprising an applicator including a tubular source of flowable medium having an upper portion and a lower portion provided with at least one opening, said source being arranged to permit at least substantially unobstructed flow of foamed medium toward said opening, and means disposed below said source and defining at least one elongated outlet communicating with said opening and arranged to convey the flowable medium from the source to the workpiece, said outlet having a first portion communicating with said opening, a second portion arranged to discharge the medium from the applicator, and a third portion between said first and second portions, said applicator further having at least one deflector means provided in the third portion of said outlet, extending longitudinally of said outlet and arranged to prevent the foamed medium from flowing along a straight path from said opening downwardly from the first to the second portion of said outlet and to the workpiece, said third portion of the outlet having a substantially circular cross-sectional outline and said deflector means comprising an elongated member received with clearance in said third portion and disposed in the path of the medium issuing from the first portion of the outlet so that the medium is compelled to flow around said member on its way into the second portion of said outlet.

2. The apparatus of claim 1, further comprising a screen interposed between the applicator and the workpiece so that the deflected medium issuing from said outlet must flow through the screen on its way into contact with the workpiece.

3. The apparatus of claim 2, wherein said screen surrounds said source.

4. The apparatus of claim 1, wherein said outlet is elongated and said outlet defining means comprises two elastically deformable sections flanking said outlet.

5. The apparatus of claim 4, wherein said applicator further comprises liners provided on said sections.

6. The apparatus of claim 5, wherein said liners include foils.

7. The apparatus of claim 5, wherein said liners consist of Teflon (trademark).

8. The apparatus of claim 1, wherein said outlet defining means is mounted on said source.

9. The apparatus of claim 8, wherein said source includes an elongated tubular housing supporting said outlet defining means and means for feeding the medium into said housing, said opening being provided in said housing.

10. The apparatus of claim 1, further comprising a support for the workpiece, said support being disposed opposite said applicator and having a passage in register with the outlet of said applicator, and suction generating means having an intake connected with said passage so that the suction generating means draws the foamed medium from the outlet of said applicator into the workpiece between said passage and said outlet.

11. The apparatus of claim 1, wherein said applicator includes a slotted squeegee.

12. Apparatus for applying a flowable foamed treating medium to a workpiece, particularly for applying a foamed medium to a running web of textile material, comprising an applicator including a tubular housing having an upper portion and a lower portion provided with an opening for evacuation of foamed treating medium from the interior of said housing, said housing being arranged to permit at least substantially unobstructed flow of foamed treating medium toward and into said opening, and a squeegee disposed below said housing and having an elongated outlet arranged to convey the treating medium from the opening toward the workpiece, said outlet including an enlarged portion; means for supplying the treating medium into said housing; and a deflector installed in the enlarged portion and extending longitudinally of said outlet and arranged to distribute the treating medium longitudinally of said outlet before the treating medium contacts the workpiece, said deflector and said squeegee defining a plurality of channels wherein the treating medium flows on its way toward the workpiece.

13. Apparatus for applying a flowable foamed treating medium to a workpiece, particularly for applying a foamed medium to a running web of textile material, comprising an applicator including a tubular housing having an upper portion and a lower portion provided with an opening for evacuation of foamed treating medium from the interior of said housing, said housing being arranged to permit at least substantially unobstructed flow of foamed treating medium toward and into said opening, and a squeegee disposed below said housing and having an elongated outlet arranged to convey the treating medium from the opening toward the workpiece; means for supplying the treating medium into said housing; and a deflector provided in said applicator in the region of and extending longitudinally of said outlet and arranged to distribute the treating medium longitudinally of said outlet before the treating medium contacts the workpiece, said deflector comprising a plurality of aligned sections which are disposed end-to-end.

14. The apparatus of claim 13, wherein said sections are identical.

15. The apparatus of claim 13, wherein said sections are substantially rod shaped and further comprising means for centering said sections in the outlet of said applicator.

16. The apparatus of claim 13, further comprising tongue-and-groove connections between the neighboring sections of said deflector.

17. The apparatus of claim 13, wherein said sections having neighboring end faces one of which is provided with a stub and the other of which has a socket for the stub.

18. Apparatus for applying a flowable foamed treating medium to a workpiece, particularly for applying a foamed medium to a running web of textile material, comprising an applicator including a tubular housing having an upper portion and a lower portion provided with an opening for evacuation of foamed treating medium from the interior of said housing, said housing being arranged to permit at least substantially unobstructed flow of foamed treating medium toward and into said opening, and a squeegee disposed below said housing and having an elongated outlet arranged to convey the treating medium from the opening toward the workpiece, said outlet including an enlarged portion and a narrower second portion, said enlarged portion being disposed between said housing and said second portion; means for supplying the treating medium into said housing; and a deflector installed in the enlarged portion and extending longitudinally of said outlet and arranged to distribute the treating medium longitudinally of said outlet before the treating medium contacts the workpiece.

19. The apparatus of claim 18, further comprising means for centering said deflector in said outlet.

20. The apparatus of claim 19, wherein said centering means comprises a plurality of relatively thin washers surrounding said deflector.

21. The apparatus of claim 18, wherein said squeegee comprises a shoe which defines said outlet and is mounted on said housing.

22. The apparatus of claim 21, wherein said housing comprises an elongated tube having at least one longitudinally extending row of openings communicating with said outlet.

23. The apparatus of claim 18, further comprising a screen or stencil interposed between the workpiece and said outlet.

24. Apparatus for applying a flowable foamed treating medium to a workpiece, particularly for applying a foamed medium to a running web of textile material, comprising an applicator including a tubular housing having an upper portion and a lower portion provided with an opening for evacuation of foamed treating medium from the interior of said housing, said housing being arranged to permit at least substantially unobstructed flow of foamed treating medium toward and into said opening, and a squeegee disposed below said housing and having an elongated outlet arranged to convey the treating medium from the opening toward the workpiece; means for supplying the treating medium into said housing; and a deflector constituting or resembling a rod and provided in said applicator in the region of and extending longitudinally of said outlet and arranged to distribute the treating medium longitudinally of said outlet before the treating medium contacts the workpiece.

25. Apparatus for applying a flowable foamed treating medium to a workpiece, particularly for applying a foamed medium to a running web of textile material, comprising an applicator including a tubular housing having an upper portion and a lower portion provided with an opening for evacuation of foamed treating medium from the interior of said housing, said housing being arranged to permit at least substantially unobstructed flow of foamed treating medium toward and into said opening, and a squeegee disposed below said housing and having an elongated outlet arranged to convey the treating medium from the opening toward the workpiece; means for supplying the treating medium into said housing; a deflector provided in said applicator in the region of and extending longitudinally of said outlet and arranged to distribute the treating medium longitudinally of said outlet before the treating medium contacts the workpiece, said deflector comprising a plurality of sections disposed end-to-end; and a plurality of centering elements spaced apart from one another, as considered in the longitudinal direction of said deflector and arranged to maintain said deflector out of contact with said housing, said sections having abutting end portions which are disposed between pairs of centering elements.

26. Apparatus for applying a flowable foamed treating medium to a workpiece, particualarly for applying a foamed medium to a running web of textile material, comprising an applicator including a tubular housing having an upper portion and a lower portion provided with an opening for evacuation of foamed treating medium from the interior of said housing, said housing being arranged to permit at least substantially unobstructed flow of foamed treating medium toward and into said opening, and a squeegee disposed below said housing and having an elongated outlet arranged to convey the treating medium from the opening toward the workpiece, said outlet including an enlarged portion nearer to and a narrower portion more distant from said housing and said opening being arranged to admit foamed treating medium into said enlarged portion of said outlet, said squeeegee further having a pair of surfaces flanking said enlarged portion and converging toward each other in a direction toward said narrower portion; means for supplying the treating medium into said housing; and a deflector having a substantially tear-shaped cross-sectional outline, provided in said outlet, extending longitudinally of said outlet, arranged to distribute the treating medium longitudinally of said outlet before the treating medium contacts the workpiece and defining with said surfaces a pair of channels wherein the treating medium flows from said opening toward the narrower portion of said outlet.

27. Apparatus for applying a flowable foamed treading medium to a workpiece, particularly for applying a foamed medium to a running web of textile material, comprising an applicator including a tubular housing having an upper portion and a lower portion provided with an opening for evacuation of foamed treating medium from the interior of said housing, said housing being arranged to permit at least substantially unobstructed flow of foamed treating medium toward and into said opening, and a squeegee disposed below said housing and having an elongated outlet arranged to convey the treating medium from the opening toward the workpiece, said outlet including an enlarged portion nearer to and a narrower portion more distant from said opening and said opening being arranged to admit foamed treating medium into said enlarged portion of said outlet, said squeegee further having a pair of surfaces flanking said enlarged portion and conveying toward each other in a direction toward said narrower portion; means for supplying the treating medium into said housing; and a deflector provided in said outlet, extending longitudinally of said outlet, arranged to distribute the treating medium longitudinally of said outlet before the treating medium contacts the workpiece and defining with said surfaces a pair of channels wherein the treating medium flows from said opening toward the narrower portion of said outlet, the combined width of said channels, as considered transversely of said applicator, approximating or matching the width of said narrower portion of said outlet.

28. Apparatus for applying a flowable foamed treating medium to a workpiece, particularly for applying a foamed medium to a running web of textile material, comprising an applicator including a tubular housing having an upper portion and a lower portion provided with an opening for evacuation of foamed treating medium from the interior of said housing, said housing being arranged to permit at least substantially unobstructed flow of foamed treating medium toward and into said opening, and a squeegee disposed below said housing and having an elongated outlet arranged to convey the treating medium from the opening toward the workpiece, said outlet including an enlarged portion nearer to and a narrower portion more distant from said opening and said opening being arranged to admit foamed treating medium into said enlarged portion of said outlet, said squeegee further having a pair of surfaces flanking said enlarged portion and converging toward each other in a direction toward said narrower portion; means for supplying the treating medium into said housing; and a deflector provided in said outlet, extending longitudinally of said outlet, arrnaged to distribute the treating medium longitudinally of said outlet before the treating medium contacts the workpiece and defining with said surfaces a pair of channels wherein the treating medium flows from said opening toward said narrower portion of said outlet, said deflector having a substantially tear-shaped cross-sectional outline and having two lateral facets each of which is substantially parallel to one of said surfaces.

29. Apparatus for applying a flowable foamed treating medium to a workpiece, particularly for applying a foamed medium to a running web of textile material, comprising an applicator including a tubular housing having an upper portion and a lower portion provided with an opening for evacuation of foamed treating medium from the interior of said housing, said housing being arranged to permit at least substantially unobstructed flow of foamed treating medium toward and into said opening, and a squeegee disposed below said housing and having an elongated outlet arranged to convey the treating medium from the opening toward the workpiece, said outlet including an enlarged portion nearer to and a narrower portion more distant from said opening and said opening being arranged to admit foamed treating medium into said enlarged portion of said outlet, said squeegee further having a pair of surfaces flanking said enlarged portion and converging toward each other in a direction toward said narrower portion; means for supplying the treating medium into said housing; a deflector provided in said outlet, extending longitudinally of said outlet, arranged to distribute the treating medium longitudinally of said outlet before the treating medium contacts the workpiece and defining with said surfaces a pair of channels wherein the treating medium flows from said opening toward the narrower portion of said outlet; and means for centering said deflector in said enlarged portion of said outlet, said centering means abutting aginst said surfaces.

30. The apparatus of claim 26, wherein said deflector has two longitudinally extending lateral facets which converge toward each other and are inwardly adjacent to said surfaces, said facets defining a ridge in the region where said enlarged portion merges into said narrower portion of said outlet.

* * * * *